United States Patent [19]

Jorgensen

[11] Patent Number: 4,486,302

[45] Date of Patent: Dec. 4, 1984

[54] SCREEN

[75] Inventor: Aage B. Jorgensen, Hojbjerg, Denmark

[73] Assignee: Aktieselskabet Nordiske Kabel- og Traadfabriker, Copenhagen, Denmark

[21] Appl. No.: 395,000

[22] PCT Filed: Oct. 12, 1981

[86] PCT No.: PCT/DK81/00088

§ 371 Date: Jun. 4, 1982

§ 102(e) Date: Jun. 4, 1982

[87] PCT Pub. No.: WO82/01330

PCT Pub. Date: Apr. 29, 1982

[30] Foreign Application Priority Data

Oct. 13, 1980 [DK] Denmark ..... 4329/80

[51] Int. Cl.[3] ..... B07B 1/46

[52] U.S. Cl. ..... 209/399; 209/397; 209/405

[58] Field of Search ..... 209/399, 395, 403, 405, 209/397, 408, 409, 412; 210/499, 498, 541; 52/505, 474

[56] References Cited

U.S. PATENT DOCUMENTS 3,664,503 6/1972 Felden ..... 209/397

OTHER PUBLICATIONS

Published Specification, South Africa No. 75/6585, Union Wire Manufacturers & Eng. Works, "Shamrock et al".

*Primary Examiner*—David Lacey
*Assistant Examiner*—William Bond
*Attorney, Agent, or Firm*—Ladas and Parry

[57] ABSTRACT

In a screen consisting of a supporting frame (1) which is covered with apertured (6) screen elements (2) of resilient material, said screen elements (2) are well supported and particularly easy to replace without intervention, e.g. by way of welding, as they have longitudinal guide grooves (7) which have a profile serving to be snapped on to the upper layer (3) of the supporting frame (1) and such a depth that the lower layer (4) of the supporting frame (1) engages the underside of the screen elements (2). In a preferred embodiment the wires or bars in the lower layer (4) of the supporting frame are disposed so as to be out of alignment with the apertures (6) of the screen elements so that also the wires in this layer are protected against wear.

5 Claims, 1 Drawing Figure

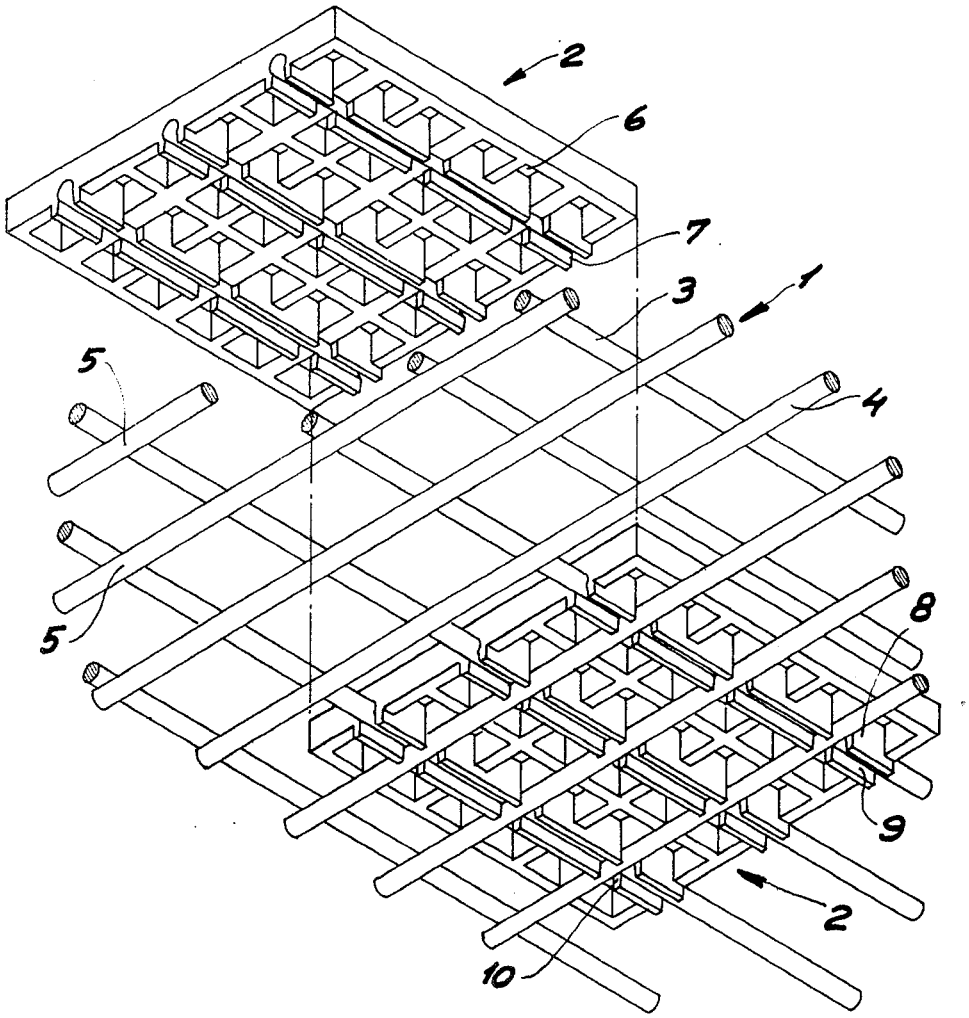
2
6
7
3
1
5
4
5
8
9
2
10

SCREEN

BACKGROUND OF THE INVENTION

The invention relates to a screen consisting of a supporting frame on whose upper side mutually adjoining, apertured screen elements of resilient material with substantially rectangular borders are detachably attached.

The apertured screen elements of resilient material are primarily to serve as wear-resistant screen means proper, but also have the task of protecting the supporting frame against the wear caused by the material treated by the screen.

However, the screen elements are nevertheless worn or otherwise damaged over an extending period of time, e.g. by falling screen material, and must therefore be replaceable.

The Norwegian Published Application No. 142 943 discloses a screen of the type mentioned above, in which the replaceable screen elements are attached to the supporting frame by means of stud-shaped fasteners. This technique is vitiated by the drawback that it requires the use of a very large number of fasteners, which can easily be lost and which can spring up when the frame is deflected. Moreover, the fasteners are damaged more or less when the screen elements are replaced.

Screens have been developed in which the fasteners are integral parts of the screen elements. However, this involves a very complicated manufacturing process which adds to the manufacturing costs of the screen elements. The integral fasteners moreover break when the individual screen elements are replaced. The resulting bottom frame becomes heavy, which reduces the vibration capacity of the machine.

The Federal Republic of Germany Utility Model No. 7 838 335 discloses a further development of a screen where the screen elements are attached by means of fasteners, which are firmly connected to a supporting structure. These fasteners are rectilinear, specially made metal profiles with an upwardly open U-shaped cross-section, whose free forks are extended at the top and lockingly engage longitudinal notches in the edges of their respective one of two adjoining screen elements. Thus, the screen elements are only supported at their longitudinal edges as there is no supporting frame, and the load capacity of the screen is therefore not fully satisfactory.

Another known screen comprises a supporting frame of woven, specially made profile wires which are disposed perpendicularly to one another and to which rubber screen elements are attached, the screen elements being provided along all their edges with downwardly open grooves which can be clamped onto the wire net. The wire net cannot carry large loads without being deflected, and this construction is therefore not capable of supporting the screen elements to a satisfactory degree either. The rubber in the screen elements must moreover be so thin that it can easily be replaced, but this significantly reduces the wear resistance.

OBJECTS OF THE INVENTION

The object of the invention is to form the screen elements so that, without the use of loose fasteners, they can be attached directly to and be firmly supported by a very rigid and pressure resistant supporting frame, which is quite conventionally attached without any intervention in the machine by way of welding, and from which the screen elements are easy to remove or mount in case of replacement. It is a further object that the screen is easy to adapt to various mesh sizes by replacing the screen elements by others which have different aperture sizes, but fit on the same supporting frame, which can be conventionally replaced easily and rapidly by a supporting frame of a different module.

SUMMARY OF THE INVENTION

These objects are achieved according to the invention by constructing the screen defined in the foregoing so that the supporting frame consists of an upper and a lower layer of substantially rectilinear, mutually parallel metal bars, the bars in the upper layer being disposed transversely to the bars in the lower layer and joined with the bars of said layer in the intersections, each screen element having at its underside at least two longitudinal guide grooves located outside the area of the apertures, said guide grooves having a profile permitting said grooves to be snapped on to the upper layer of bars of the supporting frame, said guide grooves having such a depth that the lower layer of bars of the supporting frame can engage the underside of the screen elements. When the individual screen elements are to be replaced, they are just pulled upwards with a certain force in a direction perpendicular to the plane of the supporting frame so as to remove the clamping effect of a snap fastener nature between the guide grooves and the upper layer of metal bars in the supporting frame. The new screen elements are then brought into place with the guide grooves just above the upper layer of metal bars and are snapped on by being pressed downwards. The overall screen or mesh area can be increased by 20 to 30% over the previous known constructions owing to the effective support provided by the frame.

The supporting frame may be a standard screen of the type which was previously used for screening purposes and which can be mounted on all known screening machines without changing the frame of the machine or its set-up.

The screen elements themselves may have a mesh opening from 1 mm and up to 100–120 mm without any change of the supporting frame. The supporting frame for such a screen may easily be produced even under simplest manufacturing conditions merely by inverting the screen elements and then placing round bars in the guide grooves, where they may then be attached to form a net, which in turn is welded correctly together so as to form a rigid grid when the round bars have been removed from the screen elements.

The manufactured screen elements are also advantageous in terms of casting. They can be made of plastics or rubber or another resilient material, which may optionally be reinforced.

When the bars in the lower layer of the supporting frame are disposed so as to be out of alignment with the apertures of the screen elements, provision is made for support to the full extend of the bars in the lower layer of the supporting frame, and these bars are covered at the same time and thus protected in their full extent by the screen elements.

BRIEF DESCRIPTION OF THE DRAWING

The invention will be described more fully below with reference to the drawing, which shows a perspective view of an embodiment of a screen according to the invention, seen obliquely from below.

DESCRIPTION OF THE PREFERRED EMBODIMENT

The drawing shows a supporting frame 1 and two identical screen elements 2, one of which is shown attached to the supporting frame 1, and other is shown in a position vertically above the supporting frame 1.

The supporting frame 1 consists of a plurality of rectilinear, mutually parallel metal bars 3, which are disposed in an upper layer, and a plurality of likewise rectilinear, parallel metal bars 4, which are disposed perpendicularly to the bars 3 of the upper layer and are attached to the underside of the upper metal bars 3, e.g. by welding, in the intersections 5 of the wires 3,4. It will be noted that the bars 3 of the upper layer and the bars 4 of the lower layer lie in only their own layer. Bars 3 and 4 are generally uniform in shape.

The screen elements 2, which have rectangular borders, are provided with apertures 6 through which the material to be treated is passed. The screen elements have on their underside three guide grooves 7, which are not aligned with the areas of the apertures 6 and have such a profile that they can be snapped on to the upper layer of metal wires 3 in the supporting frame.

The guide grooves 7 have such a depth that the lower layer of bars 4 of the supporting frame engages the underside of the screen elements 2 when the screen elements are attached to the supporting frame 1. Moreover, the metal bars 4 in the lower layer of the supporting frame 1 are disposed so that they are out of alignment with the apertures 6 of the screen elements 2.

In the shown embodiment the sides 8 and 9 of the guide grooves 7 extend downwardly past the lowest layer of metal bars 4 and are therefore provided with recesses 10 at each intersection for the passage of the metal bars 4.

I claim:

1. A screen which comprises a rigid supporting frame on whose upper side mutually adjoining apertured screen elements of resilient material with substantially rectangular borders are detachably supported, said supporting frame consisting essentially of an upper and a lower layer of substantially rectilinear, mutually parallel metal bars, the bars of the respective layers lying essentially in only their own layer, so that the bars of the upper layer lie only above the bars of the lower layer, the bars in the upper layer being disposed transversely to the bars in the lower layer and joined with the bars of said lower layer at intersections of said bars of said respective layers whereby to form a rigid grid, each screen element having at its underside at least two longitudinal guide grooves located at borders outside the areas of the apertures, said guide grooves being constructed and arranged to be snapped onto the upper layer of bars, said guide grooves having sufficient depth that the lower layer of the bars of the supporting frame can engage the underside of the screen elements when the screen elements are supported by the upper layer, opposing sides of the guide grooves being provided with recesses for accomodating the passage of the transversely extending bars of the lower layer.

2. A screen according to claim 1, in which the bars in the lower layer of the supporting frame are disposed so as to be out of alignment with the apertures of the screen elements.

3. A screen according to claim 1, in which a plurality of apertures in the screen element lie within the rectangular borders of said screen element.

4. A screen according to claim 1, in which the bars of both layers are substantially round.

5. A screen according to claim 1, in which the bars of both layers are substantially uniform in shape.

* * * * *